US006129354A

United States Patent [19]

Giraldo

[11] Patent Number: 6,129,354

[45] Date of Patent: Oct. 10, 2000

[54] AMUSEMENT DEVICE SIMULATING A WISHING WELL

[76] Inventor: Juan Carlos Giraldo, 64 Walthan St., Watertown, Mass. 02172

[21] Appl. No.: 09/121,345

[22] Filed: Jul. 23, 1998

[51] Int. Cl.[7] ..... A63B 71/00

[52] U.S. Cl. ..... 273/138.2; 273/138.1; 273/161; 463/16; 463/22

[58] Field of Search ..... 273/138.1, 138.2, 273/139, 161; 463/16, 17, 18, 22

[56] References Cited

U.S. PATENT DOCUMENTS 5,176,380 1/1993 Evans et al. ..... 463/16
5,472,196 12/1995 Rusnak ..... 273/138 R
5,772,510 6/1998 Roberts ..... 463/17
5,785,594 7/1998 Sibert, Jr. et al. ..... 463/17

*Primary Examiner*—Benjamin H. Layno

[57] ABSTRACT

An amusement device for providing a printout to a user after the user throws a coin or token into the amusement device. The amusement device includes a base having an interior, a top, a bottom. The top of the base has depression extending towards the bottom of the base. The depression has an opening into the interior of the base. A computer is provided for generating a message. A printer is provided for printing a printout of the message generated by the computer. A switch is provided for selectively activating the computer to generate the message. The switch has an actuator provided in the base which is positioned adjacent the opening of the depression such that passage of an item through the opening of the depression actuates the actuator.

1 Claim, 3 Drawing Sheets

AMUSEMENT DEVICE SIMULATING A WISHING WELL

BACKGROUND OF THE INVENTION

1. Field of the Invention

The present invention relates to amusement devices, especially gambling amusement devices and more particularly pertains to a new amusement device for providing a printout to a user after the user throws a coin or token into the amusement device.

2. Description of the Prior Art

The use of amusement devices, especially gambling amusement devices is known in the prior art. More specifically, amusement devices, especially gambling amusement devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art amusement devices include U.S. Pat. Nos. 4,871,055; 5,176,238; 5,385,347; 5,301,942; 3,168,179; and U.S. Pat. No. Des. 304,810.

While these devices fulfill their respective, particular objectives and requirements, the aforementioned patents do not disclose a new amusement device. The inventive device includes a base having an interior, a top, a bottom. The top of the base has depression extending towards the bottom of the base. The depression has an opening into the interior of the base. A computer is provided for generating a message. A printer is provided for printing a printout of the message generated by the computer. A switch is provided for selectively activating the computer to generate the message. The switch has an actuator provided in the base which is positioned adjacent the opening of the depression such that passage of an item through the opening of the depression actuates the actuator.

In these respects, the amusement device according to the present invention substantially departs from the conventional concepts and designs of the prior art, and in so doing provides an apparatus primarily developed for the purpose of providing a printout to a user after the user throws a coin or token into the amusement device.

SUMMARY OF THE INVENTION

In view of the foregoing disadvantages inherent in the known types of amusement devices, especially gambling amusement devices now present in the prior art, the present invention provides a new amusement device construction wherein the same can be utilized for providing a printout to a user after the user throws a coin or token into the amusement device.

The general purpose of the present invention, which will be described subsequently in greater detail, is to provide a new amusement device apparatus and method which has many of the advantages of the amusement devices, especially gambling amusement devices mentioned heretofore and many novel features that result in a new amusement device which is not anticipated, rendered obvious, suggested, or even implied by any of the prior art amusement devices, especially gambling amusement devices, either alone or in any combination thereof.

To attain this, the present invention generally comprises a base having an interior, a top, a bottom. The top of the base has depression extending towards the bottom of the base.

The depression has an opening into the interior of the base. A computer is provided for generating a message. A printer is provided for printing a printout of the message generated by the computer. A switch is provided for selectively activating the computer to generate the message. The switch has an actuator provided in the base which is positioned adjacent the opening of the depression such that passage of an item through the opening of the depression actuates the actuator.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new amusement device apparatus and method which has many of the advantages of the amusement devices, especially gambling amusement devices mentioned heretofore and many novel features that result in a new amusement device which is not anticipated, rendered obvious, suggested, or even implied by any of the prior art amusement devices, especially gambling amusement devices, either alone or in any combination thereof.

It is another object of the present invention to provide a new amusement device which may be easily and efficiently manufactured and marketed.

It is a further object of the present invention to provide a new amusement device which is of a durable and reliable construction.

An even further object of the present invention is to provide a new amusement device which is susceptible of a low cost of manufacture with regard to both materials and labor, and which accordingly is then susceptible of low prices of sale to the consuming public, thereby making such amusement device economically available to the buying public.

Still yet another object of the present invention is to provide a new amusement device which provides in the apparatuses and methods of the prior art some of the advantages thereof, while simultaneously overcoming some of the disadvantages normally associated therewith.

Still another object of the present invention is to provide a new amusement device for providing a printout to a user after the user throws a coin or token into the amusement device.

Yet another object of the present invention is to provide a new amusement device which includes a base having an interior, a top, a bottom. The top of the base has depression extending towards the bottom of the base. The depression has an opening into the interior of the base. A computer is provided for generating a message. A printer is provided for printing a printout of the message generated by the computer. A switch is provided for selectively activating the computer to generate the message. The switch has an actuator provided in the base which is positioned adjacent the opening of the depression such that passage of an item through the opening of the depression actuates the actuator.

Still yet another object of the present invention is to provide a new amusement device that may be used as a gambling device to generate a random set of numbers or images to be compared to a predetermined set of numbers or images to see if the generated set of numbers or images match the predetermined ones for the user to win a prize.

Even still another object of the present invention is to provide a new amusement device that may be used to generate a message to promote goods or services to a user. For example, a company promoting a product or service could give a message about the product or service to a user depositing a coin into the amusement device with the coin being given to charity to further enhance the stature of the company in the eyes of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
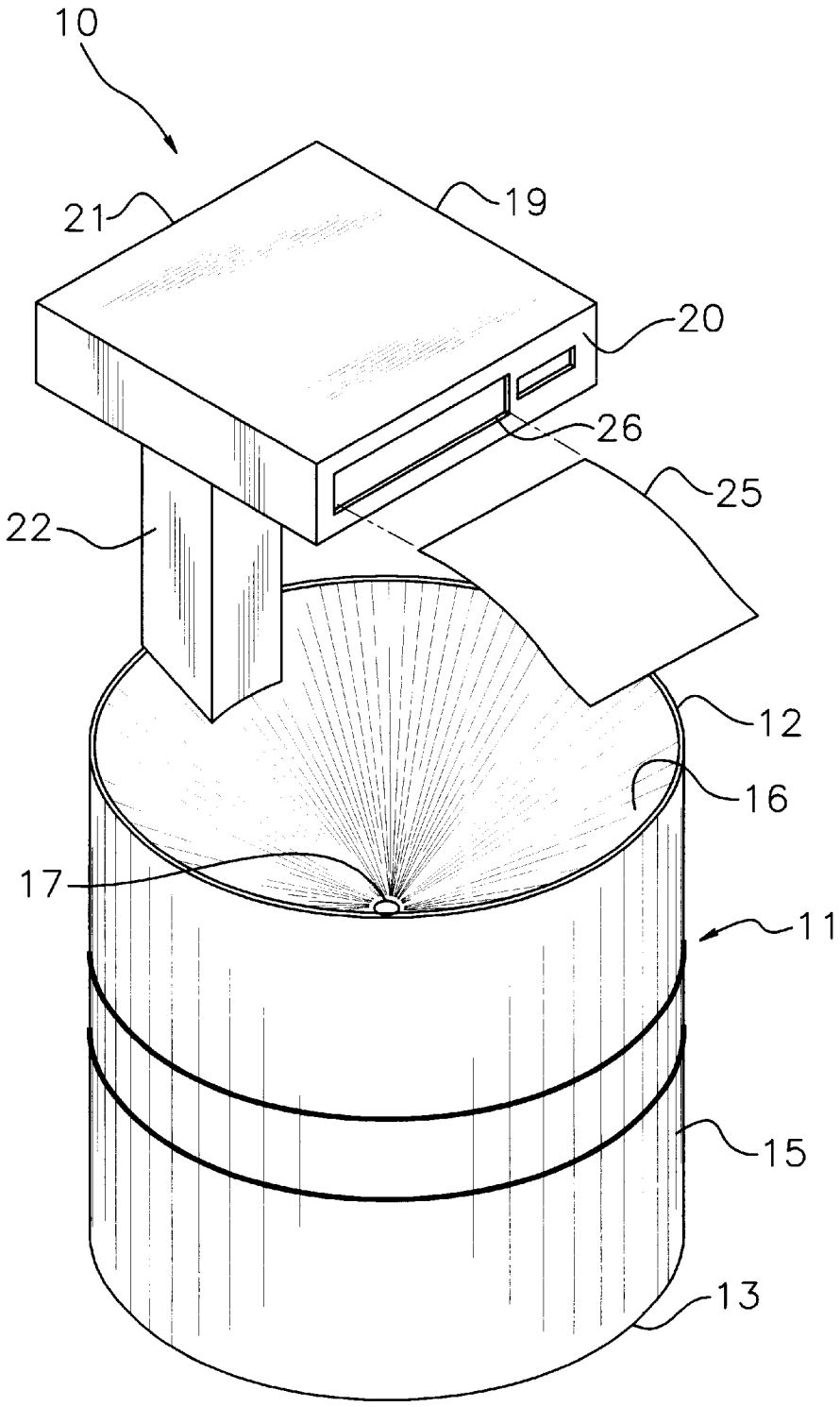
FIG. 1 is a schematic perspective view of a new amusement device according to the present invention.
Figure 2:
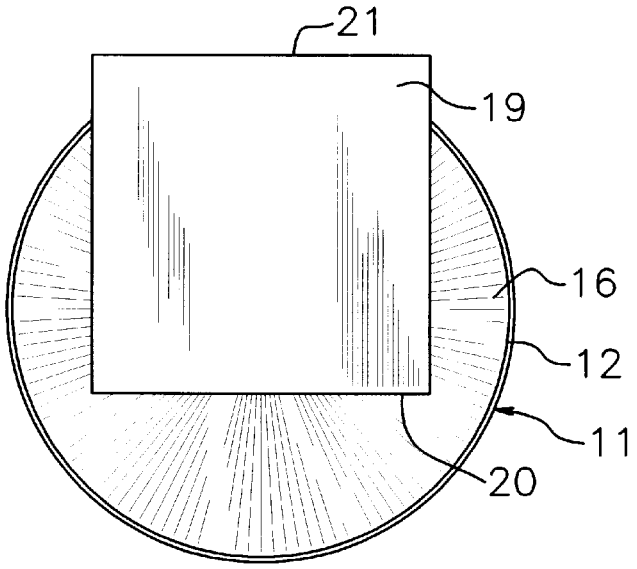
FIG. 2 is a schematic top view of the present invention.
Figure 3:
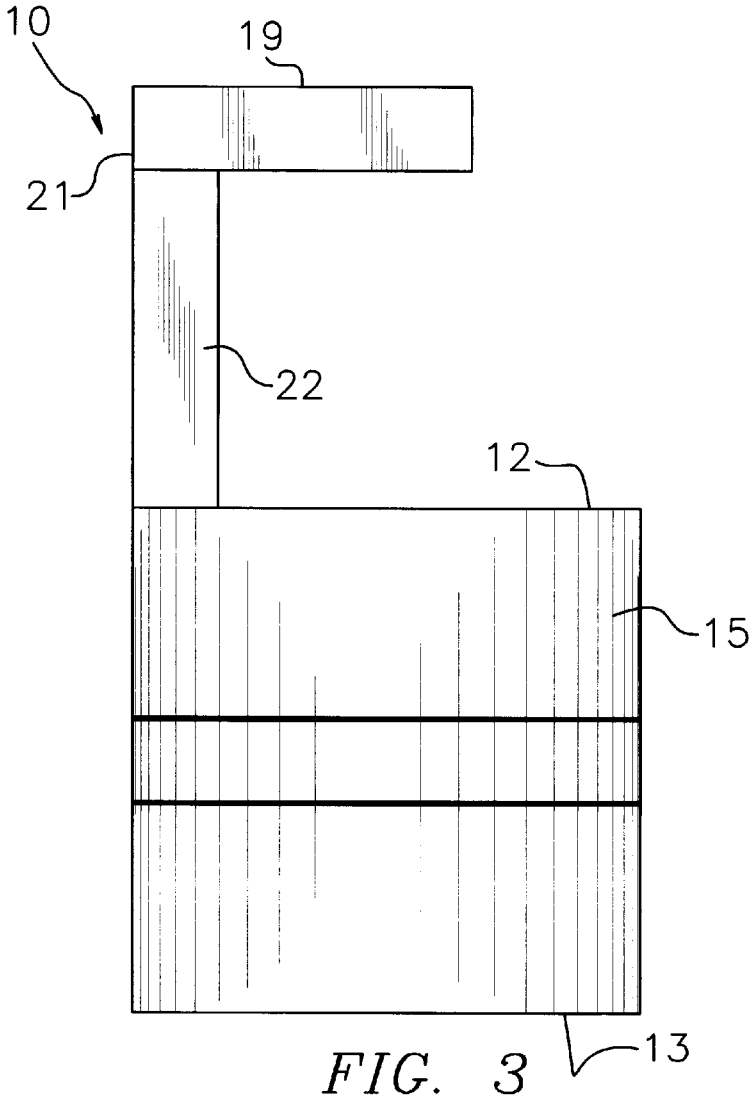
FIG. 3 is a schematic side view of the present invention.
Figure 4:
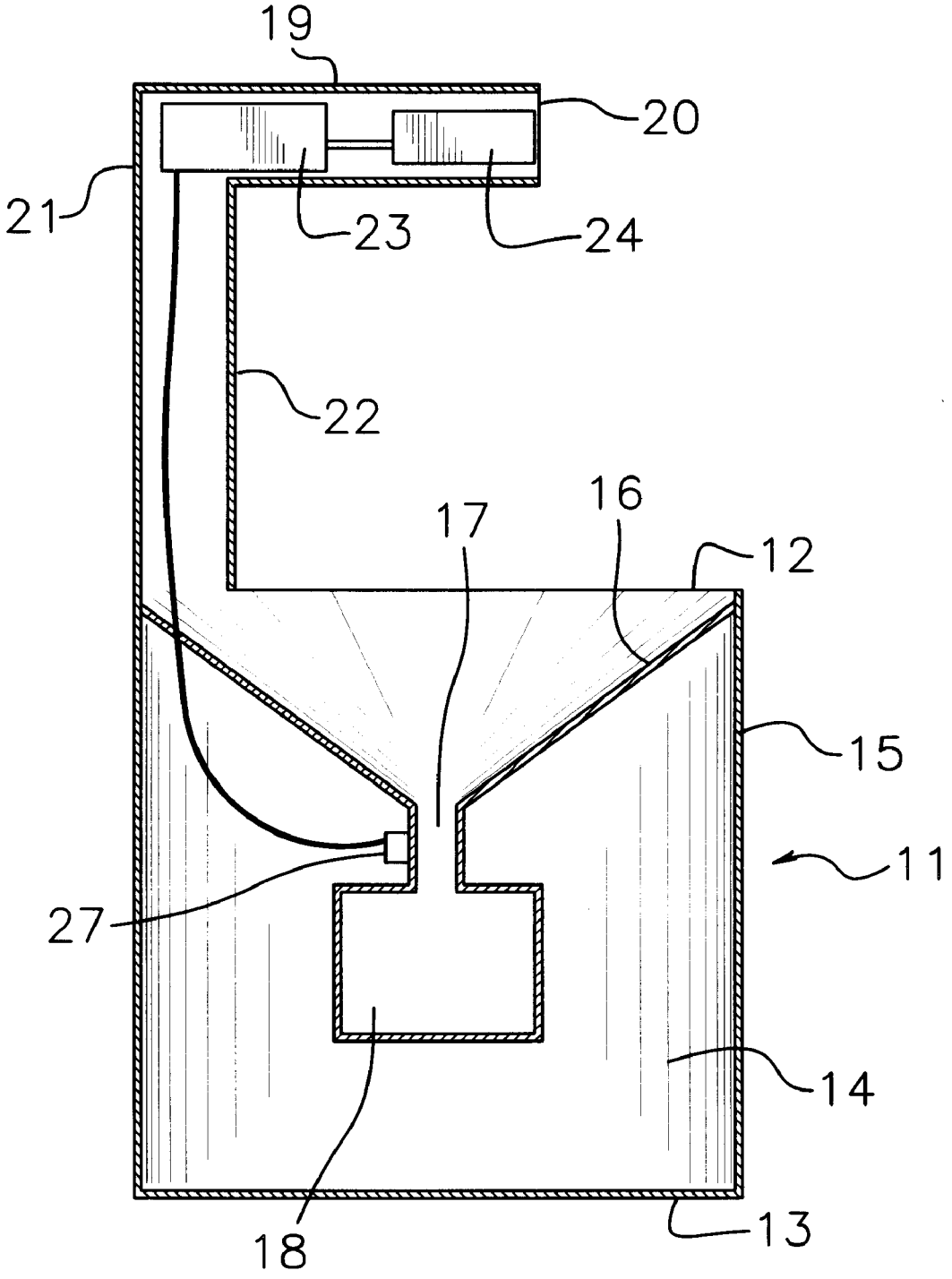
FIG. 4 is a schematic cross sectional view of the present invention.

With reference now to the drawings, and in particular to FIGS. 1 through 4 thereof, a new amusement device embodying the principles and concepts of the present invention and generally designated by the reference numeral 10 will be described.

As best illustrated in FIGS. 1 through 4, the amusement device 10 generally comprises a base 11 having an interior 14, a top 12, a bottom 13. The top 12 of the base 11 has depression 16 extending towards the bottom 13 of the base 11. The depression 16 has an opening 17 into the interior 14 of the base 11. A computer 23 is provided for generating a message. A printer 24 is provided for printing a printout 25 of the message generated by the computer 23. A switch is provided for selectively activating the computer 23 to generate the message. The switch has an actuator 27 provided in the base 11 which is positioned adjacent the opening 17 of the depression 16 such that passage of an item through the opening 17 of the depression 16 actuates the actuator 27.

The amusement device 10 is designed for generating a message when a user deposits an item such as a coin or token into the amusement device. In closer detail, the base 11 is generally cylindrical and has an interior 14, a top 12, a bottom 13, and an exterior 15 ideally formed to resemble a water well. The top 12 has a circular outer perimeter and depression 16 extending towards the bottom 13 of the base 11. The depression 16 is generally conical and has a lower vertex positioned between the top 12 and bottom 13 of the base 11. Ideally, the depression 16 is formed and colored to resemble the interior 14 of a water well including the water in the water well. The depression 16 is designed for tossing items such as coins and tokens therein by a user to simulate the tossing of the item into a wishing well. The depression 16 has an opening 17 into the interior 14 of the base 11. The opening 17 of the depression 16 is located at the lower vertex of the depression 16. The opening 17 of the depression 16 is adapted for (e.g., sufficiently sized for) permitting the passage therethrough into the interior 14 of the base 11 of coins and tokens thrown into the depression 16. Optionally, the interior 14 of the base 11 has a container 18 for holding coins and tokens which is in communication with the opening 17 of the depression 16 such that coins and tokens passing through the opening 17 of the depression 16 into the interior 14 of the base 11 are collected in the container 18.

An upper housing 19 is supported above the top 12 of the base 11 preferably by an elongate shaft 22 upwardly extending generally vertically from the top 12 of the base 11. The upper housing 19 is ideally generally rectangular and has a front 20 and a back 21. The shaft 22 has a lower end coupled to the top 12 of the base 11. The lower end of the shaft 22 is preferably positioned adjacent the outer perimeter of the top 12 of the base 11. The shaft 22 has an upper end coupled to the upper housing 19 and is preferably positioned adjacent the back 21 of the upper housing 19 such that the upper housing 19 extends in a direction from the outer perimeter of the base 11 towards the vertex of the depression 16.

The computer 23 for generating a message is preferably provided in the upper housing 19. Also provided in the upper housing 19 is the printer 24 which is electrically connected to the computer 23 for printing a printout 25 of the message generated by the computer 23. The front 20 of the upper housing 19 has an opening 26 for permitting passage therethrough of the printout 25 printed by the printer 24. A switch is electrically connected to the computer for selectively activating the computer 23 to generate the message. The switch has an actuator 27 provided in the base 11 and positioned below the opening 17 of the depression 16 such that passage of an item such as a coin or token regardless of composition and denomination, through the opening 17 of the depression 16 actuates the actuator 27. When the actuator 27 is actuated by the item, the switch then activates the computer 23.

In one ideal embodiment, the message generated by the computer 23 comprises a set of randomly generated numbers which are to be compared to a predetermined set of numbers to see if they match for the user to win a prize such as in a lottery. In another ideal embodiment, the message generated by the computer 23 comprises a set of randomly generated images which are to be compared to a predetermined set of images to see if they match for the user to win a prize. In a third ideal embodiment, the message generated by the computer 23 may comprises a message to promote goods and services by a company.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An amusement device for generating a message when a user deposits an item into said amusement device, said amusement device comprising:

a base being generally cylindrical and having an interior, a top, a bottom, and an exterior formed to resemble a water well;

said top having a circular outer perimeter and depression extending towards said bottom of said base;

said depression being generally conical and having a lower vertex positioned between said top and bottom of said base;

wherein said depression is formed and colored to resemble the interior of a water well including the water in the well;

said depression having an opening into said interior of said base, said opening of said depression being located at said lower vertex of said depression, said opening of said depression being adapted for permitting the passage of coins and tokens therethrough into said interior of said base;

said interior of said base defining a container for holding coins and tokens, said container being in communication with said opening of said depression such that coins and tokens, regardless of composition and denomination, passing through said opening of said depression into said interior of said base are collected in said container;

an upper housing being supported above said top of said base, wherein an elongate shaft upwardly extending generally vertically from said top of said base supports said upper housing above said top of said base;

said upper housing having a front and a back;

said shaft having a lower end coupled to said top of said base, said lower end of said shaft being positioned adjacent said outer perimeter of said top of said base, said shaft having an upper end coupled to said upper housing, said upper end of said shaft being positioned adjacent said back of said upper housing;

a computer for generating a message, said computer being provided in said upper housing;

a printer for printing a printout of said message generated by said computer, said printer being electrically connected to said computer, said printer being provided in said upper housing;

said front of said upper housing having an opening for permitting passage therethrough of said printout printed by said printer; and a switch for selectively activating said computer to generate said message, said switch being electrically connected to said computer, said switch having an actuator provided in said base, said actuator being positioned below said opening of said depression such that passage of coins and tokens, regardless of composition and denomination, through said opening of said depression actuates said actuator, said switch activating said computer when said actuator is actuated, said computer generating said message upon the item actuating said actuator;

wherein said message generated by said computer comprises a set of randomly generated numbers, said randomly generated numbers being for comparing to a predetermined set of numbers to see if they match for the user to win a prize; and wherein said message generated by said computer comprises a set of randomly generated images, said randomly generated images being for comparing to a predetermined set of images to see if they match for the user to win a prize.

* * * * *